US005182891A

United States Patent [19]

Slocum

[11] Patent Number: 5,182,891

[45] Date of Patent: Feb. 2, 1993

[54] RAISED INSULATED AND WATER RESISTANT COMPOSITE FLOORING MATERIAL

[76] Inventor: Donald Slocum, 61 Chimney Ridge Dr., Convent Station, N.J. 07961

[21] Appl. No.: 556,652

[22] Filed: Jul. 20, 1990

[51] Int. Cl.[5] ..... E04B 9/28

[52] U.S. Cl. ..... 52/480; 52/392; 52/586; 52/729

[58] Field of Search ..... 52/480, 390, 391, 392, 52/512, 509, 586, 729, 481, 508, 585

[56] References Cited

U.S. PATENT DOCUMENTS

| | | | |
|---|---|---|---|
| 4,170,859 | 10/1979 | Counihan | 52/391 X |
| 4,599,842 | 7/1986 | Counihan | 52/512 X |
| 4,616,462 | 10/1986 | Abendroth | 52/512 X |
| 4,640,076 | 2/1987 | Migliore | 52/512 X |
| 4,671,038 | 6/1987 | Porter | 52/586 |
| 4,703,601 | 11/1987 | Abendroth | 52/512 X |
| 4,860,508 | 8/1989 | Jackson et al. | 52/480 X |
| 5,016,413 | 5/1991 | Counihan | 52/480 X |

FOREIGN PATENT DOCUMENTS 8801669 6/1987 PCT Int'l Appl. ..... 52/390

*Primary Examiner*—David A. Scherbel
*Assistant Examiner*—Kien Nguyen
*Attorney, Agent, or Firm*—McGlew and Tuttle

[57] ABSTRACT

A flooring construction is provided having a unitary construction with a top layer providing a finished flooring surface and an insulation layer adjacent the top layer. The flooring panel includes an upper portion and a lower portion. The upper portion has a larger dimension than the lower portion and extends outwardly beyond the lower portion. A recessed portion between the upper portion and the lower portion defines a channel. A plurality of interlock support elements having a vertical web and an upper horizontal flange are arranged so that the horizontal flange extends into the channel. The vertical web extends below the lower portion to raise the flooring.

7 Claims, 3 Drawing Sheets

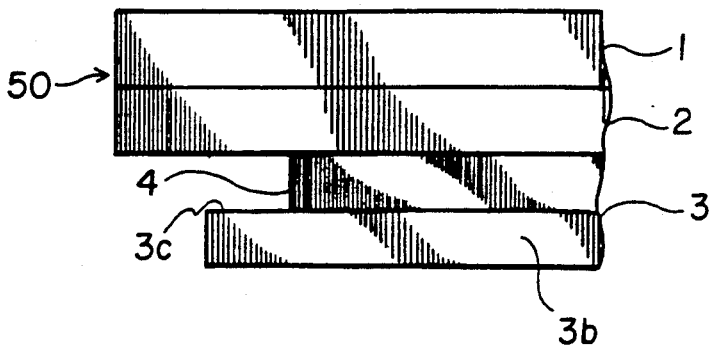
Fig. 2
Fig. 3
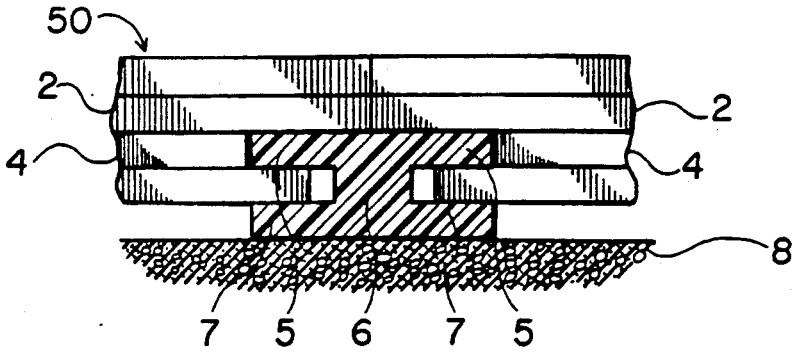

RAISED INSULATED AND WATER RESISTANT COMPOSITE FLOORING MATERIAL

FIELD AND BACKGROUND OF THE INVENTION

The present invention relates in general to flooring and in particular to raised composite sections of flooring.

Flooring material or floor covering material in residential use is in general meant to be applied in direct flat contact with the surface to be floored. However this direct flat contact is not always desirable especially below grade. There may be situations where the surface to be floored causes difficulty in attaching flooring due to irregularities in that surface. The surface may have moisture problems such as a basement or may be applied over insulation thereby resulting in localized support problems caused by compression.

SUMMARY AND OBJECTS OF THE INVENTION

Is is an object of the invention to overcome the problems discussed above by providing floor structure which is slightly raised above the surface to be floored and which eliminates these and other problems common to those products generally used in residential or commercial flooring applications.

The invention provides a flooring that is modular, supported on at least two and preferably four edges and raised above the surface to be floored. Since the bottom of the flooring is not in contact with the surface, insulation and waterproofing materials can be applied to the bottom of the module without difficulty.

Also provided in the invention is an interlock support member which is in the form of an I or T-beam. This member can be made of but not limited to, formed plastic or fabricated from wood based materials. One flat side of the member is interlocked by a tongue and groove mechanism to the module and one side is in contact with the surface to be floored.

The flooring consists of at least one layer of thin embossed or engraved material forming the top of the flooring module or panel. Subsequent layers such as an insulating layer are attached to the thin embossed material to form the bottom section of the flooring module or panel.

A horizontal channel is formed in each of the four sides or edges of each flooring module or panel. These channels are inserted into the upper horizontal flanges of the interlock support members which are fastened to the surface to be floored.

The flooring can be slid in and out from the side of the interlock support members. By this construction, the flooring or sections of the flooring are easily removable and replaceable.

Additional layers can be attached to the thin embossed or engraved material layer. This can be done in order to impart additional strength to the flooring or to enhance the appearance.

The arrangement also allows replacement or overlaying of floors in old buildings which are not level and the like by providing connecting members which readily shimmed in an opposite sense to the flooring to thereby provide a slightly elevated but leveled floor.

It is still a further object of the invention, to provide a flooring product which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2 is an enlarged side view of a corner of the flooring panel to the invention;

FIG. 3 is a side view of two flooring panels locked and supported by the interlock support member according to the invention;

DESCRIPTION OF THE PREFERRED EMBODIMENT

Figure 1:
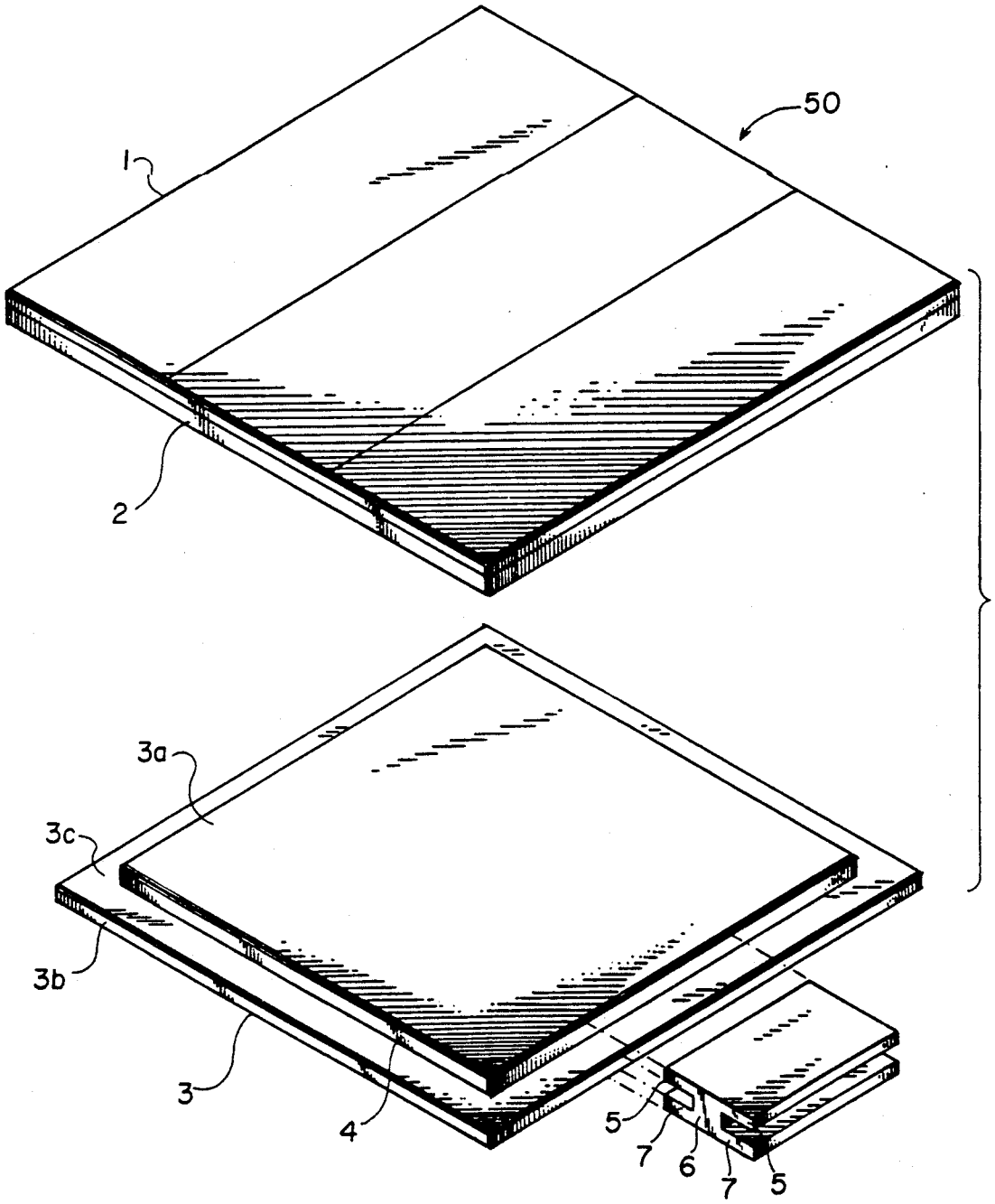
FIG. 1 is an exploded perspective view of a flooring panel and interlock member according to the invention.
Figure 4:
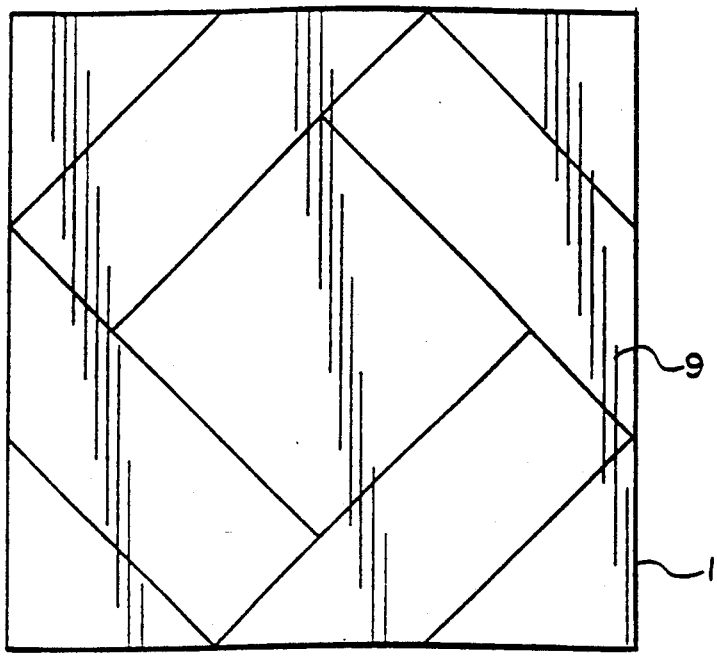
FIG. 4 is an example of one pattern that can be applied to the top layer of the flooring panel.
Figure 5:
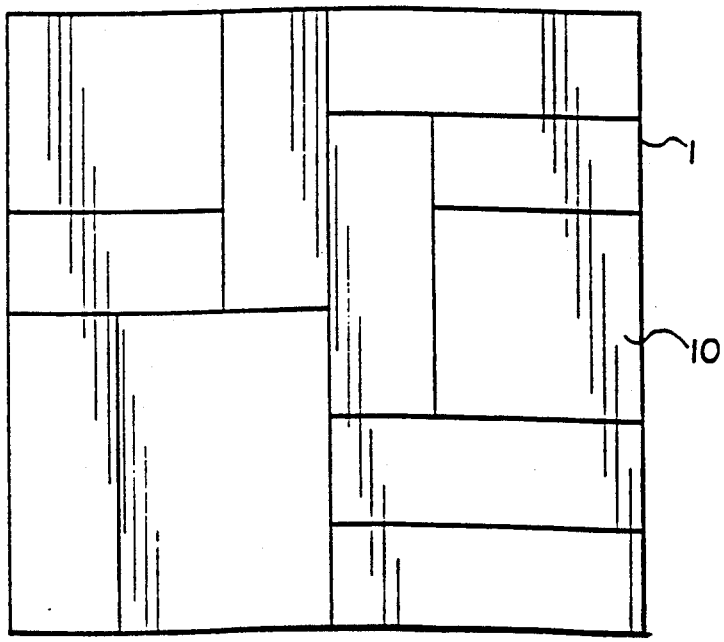
FIG. 5 is a second example of a pattern that can be applied to the top layer of the flooring panel.

Referring to the drawings in particular, the invention embodied therein comprises a floor product or floor panel generally designated 50.

FIG. 1 illustrates an exploded view of a particular embodiment of a flooring panel with a top layer 1 having a plank design on its surface. The top layer may be a high quality wood veneer or other veneer including stone, marble, synthetic marble, vinyl etc. Below the top layer 1 a rigid layer 2 is provided. An insulating layer 3 is provided below the rigid layer 2. The insulating layer 3 is provided with a reduced width section **3*a* and a base section 3*b* which defines a flange 3C. A horizontal channel 4 is formed between the rigid layer 2 and by the flange 3C of the insulating layer 3. A side view of a corner of the flooring panel is enlarged in FIG. 2 showing the top layer 1, the rigid layer 2, the insulating layer 3 and the horizontal channel 4**.

An interlock support beam is also shown in FIG. 1 having a vertical web 6, upper horizontal flanges 5 and lower horizontal flanges 7.

In FIG. 3 a side view of the joint between two flooring panels is shown. Each of the horizontal channels 4 is adapted to lock onto one of the horizontal flanges 5 for joining the panels in close proximity. The rigid layer 2 rests on top of and is supported by the upper horizontal flange 5. Vertical web 6 supports upper horizontal flange 5, and lower horizontal flange 7 attaches vertical web 6 to a surface to be floored 8. Thus raising the flooring panel above the surface to be floored 8.

According to the invention the floor panel product generally designated 50 is formed of the top layer 1, the rigid layer 2, and the insulating layer 3 as shown especially in FIG. 1. The insulating layer 3 is formed of extruded polystyrene foam which is preferably extruded to provide the shaped structure including the reduced width section **3*a* and the base section 3*b* with flange 3*c* formed as an integral unit. The extruded polystyrene foam is preferably cut into units as shown in FIG. 1 with the maximum dimension of the base 3*b* being slightly smaller than the maximum dimension of the top layer 1 and the rigid layer 2. The insulating layer 3 may also be formed by injection molding or a similar process which provides a shaped structure. The insulation layer is preferably made of foam but could also be made of hardboard, particle board, OSB, waferboard or insulation boards for examples. The rigid layer and the top layer 1 all provide a composite laminate form which are connected to the insulating layer 3**.

The foam backing acts to protect against moisture and to insulate the entire structure. The composite laminate form may be made from hardboard or filled acrylic of polyestic or other plastic and may be connected to extruded polystyrene foam. Water resistant extruded hardboard with a formula containing additives such as wax, silicon, resins and the like may be used to form the laminate top layer rigid layer structure.

Various patterned surfaces 9, 10 can be applied to the top layer 1 to alter its appearance.

Example 1: hardboard top layer, hardboard rigid layer, hardboard insulating layer and hardboard joint wherein the top layer is provided with a urethane finish.

Example 2: film coated hardboard top layer 1 with hardboard in rigid layer and hardboard insulating layer and hardboard joint.

Example 3: hardboard top layer, hardboard rigid layer and foam backed insulating layer.

Example 4: acrylic face top layer, hardboard rigid layer and polystyrene foam insulating layer.

Example 5: a pre-finished hardboard top layer, hardboard rigid layer, softboard insulating layer.

While a specific embodiment of the invention has been shown and described in detail to illustrate the application of the principles of the invention, it will be understood that the invention may be embodied otherwise without departing from such principles.

What is claimed is:

1. A flooring comprising:

at least one flooring panel including a rigid layer forming a top of said flooring panel an insulating layer attached to said rigid layer forming a bottom of said flooring panel and an additional pre-finished layer above said rigid layer, said additional layer having a surface of enhanced appearance, said flooring panel defining a horizontal channel formed in opposite vertical ides of said flooring panel;

support means including at least two interlock support beams, each interlock support beam having a vertical web and at least one horizontal flange, said vertical web resting on a surface to be floored and rising up from the surface to be floored, said horizontal flange being positioned on top of aid vertical web forming an overhang on at least one side, said horizontal flange of a first beam and a horizontal flange of another beam engaging said horizontal channel of said two opposite vertical sides respectively and defining a pair of interlock support beams said horizontal flanges provide support for said flooring panels on both of said opposite vertical sides, for supporting said flooring panel above said surface to be floored providing a raised flooring, said interlock support beams have said horizontal flanges on both sides of the vertical web and said horizontal flanges on each side of said vertical web are used in attaching said interlock support beam to an adjacent floor panel via engagement into said horizontal channel..

2. A flooring in accordance with claim 1 wherein: said flooring panel contains a water resistant layer.

3. A flooring in accordance with claim 1 wherein:

a portion of a bottom side of said rigid layer forms an upper wall of the said horizontal channel; and said insulating layer forms the remaining walls and sides.

4. A flooring product to be installed on a surface to be floored, formed by the steps of extruding polystyrene foam into an insulating layer component with a middle portion and a base portion, said base portion being wider than said middle portion relative to a horizontal plane, said base portion having a bottom surface, said base portion and said middle portion cooperating to form a step; forming a rigid layer having a dimension greater than said insulating layer base portion; forming a top layer with a finished upper surface defining a flooring surface; fixedly connecting said top layer to said rigid layer; and, fixedly connecting said rigid layer and said top layer to said insulating layer to define a peripheral channel of linear components of specified lengths between said rigid layer and said base part of said insulating layer; forming an interlock support member having a horizontal flange being positionable into said channel and having a vertical web extending downwardly from said horizontal flange below said base portion bottom surface to provide a contacting means for contacting a surface to be floored, and thereby supporting said base portion bottom surface above the surface to be floored defining a gap between the flooring product and the surface to be floored.

5. A flooring comprising: a plurality of flooring panels each having a substantially planar bottom plate having a thickness, a substantially planar middle plate having a shape which is similar to the shape of said bottom plate and having bottom plate area which is less than that of aid bottom plate, and having a middle plate thickness, said middle plate being integral with said bottom plate; a top substantially planar plate having a planar dimension area which is greater than said bottom plate area and being fixedly attached to a top surface of said middle plate; said bottom, middle, and top plates cooperating to form a peripheral edge defining an elongated channel between said top and bottom plates, and said middle plate defining the depth of said elongated channel; said peripheral edge defined by linear edges; a support means for supporting said flooring panels having a vertical web and a horizontal flange, said horizontal flange having a length which is substantially shorter than said peripheral edge linear edges, said horizontal flange being insertable into said elongated channel, said support member vertical web fitting below said top plate and being substantially longer than the combined thicknesses of said middle and said bottom plates thereby extending below said bottom plate, said support member and said flooring panels cooperating to define a gap under said bottom plate.

6. A flooring construction, comprising a flooring panel with a top layer providing a finished flooring surface and an insulation layer connected to said top layer, said flooring panel being rectangular in shape and including an upper portion and a lower portion, said upper portion having a larger dimension than said lower portion and extending outwardly beyond said lower portion, a recessed portion between said upper portion and said lower portion, said recessed portion cooperating with said upper portion and said lower portion to define a rectangular channel between said upper portion and said lower portion; support means including a plurality of I-beam shaped element having a vertical web and an upper horizontal flange and a lower horizontal flange, said upper horizontal flange extending into said channel between said flooring panel upper portion and said lower portion and said lower horizontal flange extending below said lower portion to support said flooring panel above a surface to be floored.

7. A flooring construction according to claim 6, wherein a second flooring panel is positioned adjacent said first flooring panel with edges of said upper portion in contact, one side of said upper horizontal flange extending into a channel of one flooring panel and another side of said upper horizontal flange extending into a channel of another flooring panel, and one side of said lower horizontal flange extending below said lower portion of said one flooring panel and another side of said lower horizontal flange extending below a lower portion of said another panel.

* * * * *